US005681156A

United States Patent [19]

Rapp

[11] Patent Number: 5,681,156

[45] Date of Patent: Oct. 28, 1997

[54] PISTON MACHINE HAVING A PISTON MOUNTED ON SYNCHRONOUSLY ROTATING CRANKSHAFTS

[76] Inventor: Manfred Max Rapp, Schöneberger Str. 84e, Hamburg, Germany

[21] Appl. No.: 351,291

[22] PCT Filed: Jun. 4, 1993

[86] PCT No.: PCT/EP93/01422

§ 371 Date: Jan. 12, 1995

§ 102(e) Date: Jan. 12, 1995

[87] PCT Pub. No.: WO93/25801

PCT Pub. Date: Dec. 23, 1993

[30] Foreign Application Priority Data

Jun. 9, 1992 [DE] Germany ..... 42 18 847.4

[51] Int. Cl.[6] ..... F01C 1/02; F01C 17/06; F01C 19/04

[52] U.S. Cl. ..... 418/54; 418/60; 418/61.1; 418/122; 418/123; 418/129

[58] Field of Search ..... 418/54, 61.1, 122–124, 418/129, 60

[56] References Cited

U.S. PATENT DOCUMENTS

| | | | |
|---|---|---|---|
| 1,864,699 | 6/1932 | Varley | 418/54 |

FOREIGN PATENT DOCUMENTS

| | | | |
|---|---|---|---|
| 0469415 | 2/1992 | European Pat. Off. . | |
| 597611 | 9/1925 | France . | |
| 1131703 | 6/1962 | Germany | 418/54 |
| 1551119 | 3/1970 | Germany . | |
| 3275996 | 12/1991 | Japan | 418/61.1 |
| 369540 | 7/1963 | Switzerland . | |

*Primary Examiner*—John J. Vrablik
*Attorney, Agent, or Firm*—Walter C. Farley

[57] ABSTRACT

A piston machine usable as an expansion engine, suction pump or compressor for a compressible medium has a housing containing a working space with two parallel walls and an interconnecting peripheral wall perpendicular to the parallel walls, the peripheral wall having a first chamber surface. A piston has a second chamber surface cooperating with the first chamber surface to form a chamber of variable volume. Two identical crankshafts rotatably mounted in the housing have crank pins rotatable in and supporting the piston, the crankshafts being coupled together for angular synchronous rotation. A first sealing element is mounted on the piston and a second sealing element is mounted on the peripheral wall. Each of the first and second chamber surfaces is formed as a sliding surface to slidingly engage the sealing element of the other of said chamber surfaces during piston rotation. The housing provides a high-pressure gas passage having an opening communicating with the chamber and a low-pressure gas passage communicating with a working space outside of the chamber.

13 Claims, 12 Drawing Sheets

PISTON MACHINE HAVING A PISTON MOUNTED ON SYNCHRONOUSLY ROTATING CRANKSHAFTS

FIELD OF THE INVENTION

The invention relates to a piston machine constituting an expansion engine, suction pump or compressor for a compressible medium having a piston mounted in a working space on crank pins of at least two identical, rotatably mounted crankshafts which are angularly synchronously coupled.

BACKGROUND OF THE INVENTION

Such a piston machine is known from US-A 1864699. The chamber surfaces on the chamber wall and on the piston which define the working chambers are composed in this construction of sliding surfaces of cylindrical segment shape which are in engagement with a sealing element in the form of a sealing strip and of relatively large flat surfaces. When the sealing strips engage, chambers are produced with very large surfaces which are substantially determined by the flat surface portions. The construction is similar to a lifting cylinder machine without a connecting rod.

A disadvantage of this known construction is the very large ratio of the chamber surface to the chamber volume, which is desirable due to its use as a steam engine and which is thermodynamically extremely unfavorable for use as a combustion machine or compressor. Another disadvantage in this construction is the variation of the force acting on the piston at differing crank angles. Since the piston area alters only slightly at different crank angles, the force acting on the piston remains virtually constant. This is unfavorable not only in use as a combustion machine but also, in particular, when used as a compressor since the piston loading becomes extremely high. Also disadvantageous is the angle at which the resulting force acting on the piston acts upon the crankshaft. Angles in the region of 90°, which result in a high torque at low bearing loads, would be desirable. In the known construction this angle of action of the force always extends, however, substantially perpendicular to the relatively large flat surface of the piston. The circumstances are similar to those in a lifting piston in which the force can only be transferred to the crank at a favorable angle of action over only a very small range of crank angles.

SUMMARY OF THE INVENTION

An object of the present invention resides in providing a piston machine of the type referred to above which may be improved thermodynamically and as regards the force variation and the angle of action of the force.

In accordance with the invention, when the chamber is becoming smaller the sealing element on the piston defining the chamber moves over the sealing element on the peripheral wall defining the chamber. When the volume of the chamber approaches zero its surfaces thus also approach zero. The result of this is a substantially constant ratio of the chamber surface to the chamber volume with very good thermodynamic characteristics, particularly as regards the heat losses at the surfaces when the chamber volume is small, that is to say at maximum compression. This results also in a substantially constant force being introduced into the piston since as the compression pressure increases the loaded piston area becomes constantly smaller. Overloading of the machine is thus prevented even at the highest compression. Combustion machines or compressors of extremely high compression may thus be realized. The force resulting on the piston is always substantially perpendicular to the line connecting the sealing elements defining the chamber. This alters its angle such that the direction of the resulting force is substantially perpendicular to the crank over a very large angular range of the crank, particularly when the chamber volume is relatively large. The result of this is very smooth, uniform movement and, with combustion machines, high torque. Furthermore, more compact construction of the piston machine is made possible by the more compact construction of the working chambers which are formed. These advantages are added to the advantages inherent in this type of construction which operates with low vibration due to the parallel rotation principle and makes high power density and favorable construction costs possible due to the possibility of the compact arrangement of a plurality of chambers. Since a complete working cycle requires only about a 180° crankshaft angle, the piston machine thus operates on the one-stroke principle and increased power density is produced with respect to other motor systems. The piston machine may be used as a suction pump, e.g. a vacuum pump, compressor or as an expansion machine, depending on its construction. It can be used as an expansion machine with external combustion, e.g. as a steam engine, or with internal combustion as an otto or diesel engine. As will be explained below in more detail, this basic construction is distinguished further by surprisingly extensive possibilities for variation and combination which make a large number of different modifications of piston machine possible which are matched to individual requirements.

Making the sealing elements with sliding surfaces of circular sector shape with a cross-section having a center at a distance from the cylinder axis of the opposing sliding surface equal to the crank radius permits particularly simple manufacture with cylindrical sliding surfaces and cylindrical surfaces of the sealing elements. The enlarged surface of the sealing elements results also, among other things, in lower wear.

The possibilities for variation of the surfaces of the sealing elements are surprisingly extensive. The surface of a sealing element can be very small so that the sealing element engages its opposing sliding surface nearly on the same line. The surfaces can be enlarged. The result of this is improved abrasion during movement because it is distributed over the surface of the sealing element. Since the opposing sliding surface is enlarged correspondingly when the surface of the sealing element is enlarged, a larger chamber is also produced. The surfaces of the sealing elements can be of circular cross-sectional construction but other curved surface constructions, particularly elliptical shapes, are also possible. The opposing sliding surfaces, which are slid over during parallel rotation, of such a sealing element then deviate from the circular shape according to the eccentricity of the surface of the sealing element. If the surface of the sealing element is elliptical, the opposing sliding surface is also elliptical. A great many chamber constructions are possible in this manner which may be matched to the individual purpose, for instance as an expansion chamber, a pump chamber or as a chamber of a low pressure or high pressure compressor. The sealing elements defining a chamber on both sides can be of different size or also of different shape. For instance, a chamber can be so constructed that it is defined on one side by a very small sealing strip with a circular section surface, whose opposing sliding surface is of circular cross-section with a radius which is only somewhat greater than the crank radius. The sealing strip on the other side of the chamber can be elliptical with very large dimensions and moves on an elliptical opposing sliding surface which is only insubstantially larger than the surface of the sealing element. A very large number of very different chambers may be made in this manner which are matched to different purposes.

The sealing elements can be situated with their plane of symmetry parallel to the plane of symmetry of the sliding surface adjacent to it or deviate from this angular position. If they are arranged tilted outwardly a lengthening of the opposing sliding surface is produced and thus a larger maximum chamber volume or a larger compression ratio.

A sealing element provided with a surface which is toothed in cross-section results in a gap of relatively high flow resistance in the event of leaks, e.g. if the sealing element lifts up, that is to say in a relatively good gas seal. This is based on gas dynamic effects white flowing through the gap which has an alternately varying breadth on the flow path which results in turbulence and thus in an increased flow resistance.

The sealing of the chambers can be effected with sealing elements which are constructed as rigid, integral components of the piston or the motor housing. The sealing elements can, however, then only be guided with a gap spacing from their opposing sliding surface having regard to the manufacturing tolerances which results in leaks which, for instance, limit the maximum compression pressure of a compression chamber. This can, however, be adequate for low pressure compressors. As a result of the construction of the sealing elements as spring-loaded sealing strips, as is generally known in the construction of engines, higher gas tightness values and thus higher compression pressures may be achieved.

The sealing strips are acted on at their rear surface by the gas pressure in the chamber alone or in addition to a spring force. The sealing force of the sealing strips thus depends on the chamber pressure and is thus always adjusted to the necessary extent.

Jumping or chattering of the sealing strips can be better suppressed by providing the mountings of the sealing strips with shock-absorbing devices.

High pressure gases from the adjacent pressurised chamber can act beneath the portion of the sealing strip enlarged in the manner of a mushroom in order to exert a force component on the sealing strip which increases the contact pressure. The sealing strips are therefore pressed with an increased contact pressure, dependent on the gas pressure to be sealed, whereby their gas tightness is improved.

A surprising result of the parallel rotation of the piston is this possibility of bringing a sliding surface provided on the piston into engagement simultaneously with two adjacent sliding surfaces on the peripheral wall. Chambers are thus defined simultaneously with the two sliding surfaces on the peripheral wall, one of which chambers operates as a compression chamber and the other as an expansion chamber, depending on the direction of rotation. This results in e.g. the possibility of providing a self-compressing combustion machine in which one chamber always compresses air which, after forming a mixture internally or externally, can be combusted in the other chamber. The separation which is provided in such a combustion machine between the compression chamber and expansion chamber produces advantages as regards cooling with better partial efficiencies of the motor. At the end of the expansion the combustion space opens and the hot gases are immediately blown with fresh air into the low pressure outlet. Due to this scavenging process the residual hydrocarbons are post-combusted so that the emission of pollutants is substantially lower than with other combustion motors. The expansion chamber can also be used as a suction pump, e.g. as a vacuum pump. A piston machine is produced in which the compression chamber supplies compressed air while the expansion chamber operates as a vacuum pump. Such a piston machine can be advantageous in certain manufacturing processes in which compressed air and vacuum are required simultaneously.

A plurality of chamber arrangements, in each case with a sliding surface provided on the piston and one or two sliding surfaces provided on the peripheral wall, can be provided distributed over the periphery of a relatively large motor at substantially any desired angles determined substantially only by the space requirement. Thus, for instance, a compressor with a plurality of chambers operating in parallel or a combustion machine with a plurality of expansion chambers or with, for instance, the same number of expansion and compression chambers may be provided. An interesting possibility which is mentioned only by way of example resides in the provision of a self-driven compressor with, for instance, an expansion chamber operating as a combustion machine and a plurality of compression chambers driven by it.

With a multiple disc construction of the machine known per se in, for instance, Wankel motors, the power may be increased in this manner according to the number of parallel discs. As a result of angularly offsetting the cranks and/or angularly offsetting the sliding surfaces in the discs, the degree of smoothness of the machine may be improved and possibilities may be provided in a construction as a combustion machine of permitting compression chambers of one disc to act directly, that is to say without intermediate pressure storage, on expansion chambers of the other disc by making use of the angular offset between the discs.

In the constructional principle of this type of machine, in which the chambers always operate only either as a compression chamber or as an expansion chamber, valves are always necessary in the high pressure passages. These can advantageously be constructed as valves controlled in synchronism with the movement of the piston, for instance in the form of lifting valves or in the form of rotary slide valves.

The valves of compression chambers can also advantageously be constructed as one-way valves, for instance as spring-loaded flap valves, whereby their spring-loading determines the desired maximum pressure.

The common mounting of two crankshafts on the piston produces an angular synchronization which is, however, very sensitive to clearances and can result in jamming. The dependence on clearances depends, however, on the number of the crankshafts so that if there are more than two crankshafts this synchronization alone can be sufficient. Absolutely exact synchronization is produced with an external coupling of the crankshafts by means of gear sets so that two crankshafts are then sufficient to mount a piston without there being a danger of jamming.

A piston shaped with a surface construction to improve air contact when it moves is cooled as it moves by contact with the gas in the working space. The piston can be provided for this purpose with ribs or with openings through which gas flows.

Heat transfer from the chambers, which are strongly heat loaded particularly in the case of a combustion machine or a high compression ratio compressor or from the working space to the bearings is prevented by providing portions which impede heat flow between the bearings of the crankshaft and the pistons so that the bearings remain cool and the possibility is provided of making the bearings of simple construction, without cooling, for instance with permanent lubrication. The portions preventing the thermal transfer can be constructed as portions with a long path and interposed cooling, e.g. air ribs, or with heat-insulating intermediate layers.

Since the piston is mounted on at least two cranks, mounting on one side is sufficient under certain circumstances and results in a substantial constructional simplification and a more compact construction of the machine.

BRIEF DESCRIPTION OF THE DRAWINGS

The invention is illustrated schematically and by way of example in the drawings, in which.

DESCRIPTION OF THE PREFERRED EMBODIMENTS

Figure 1:
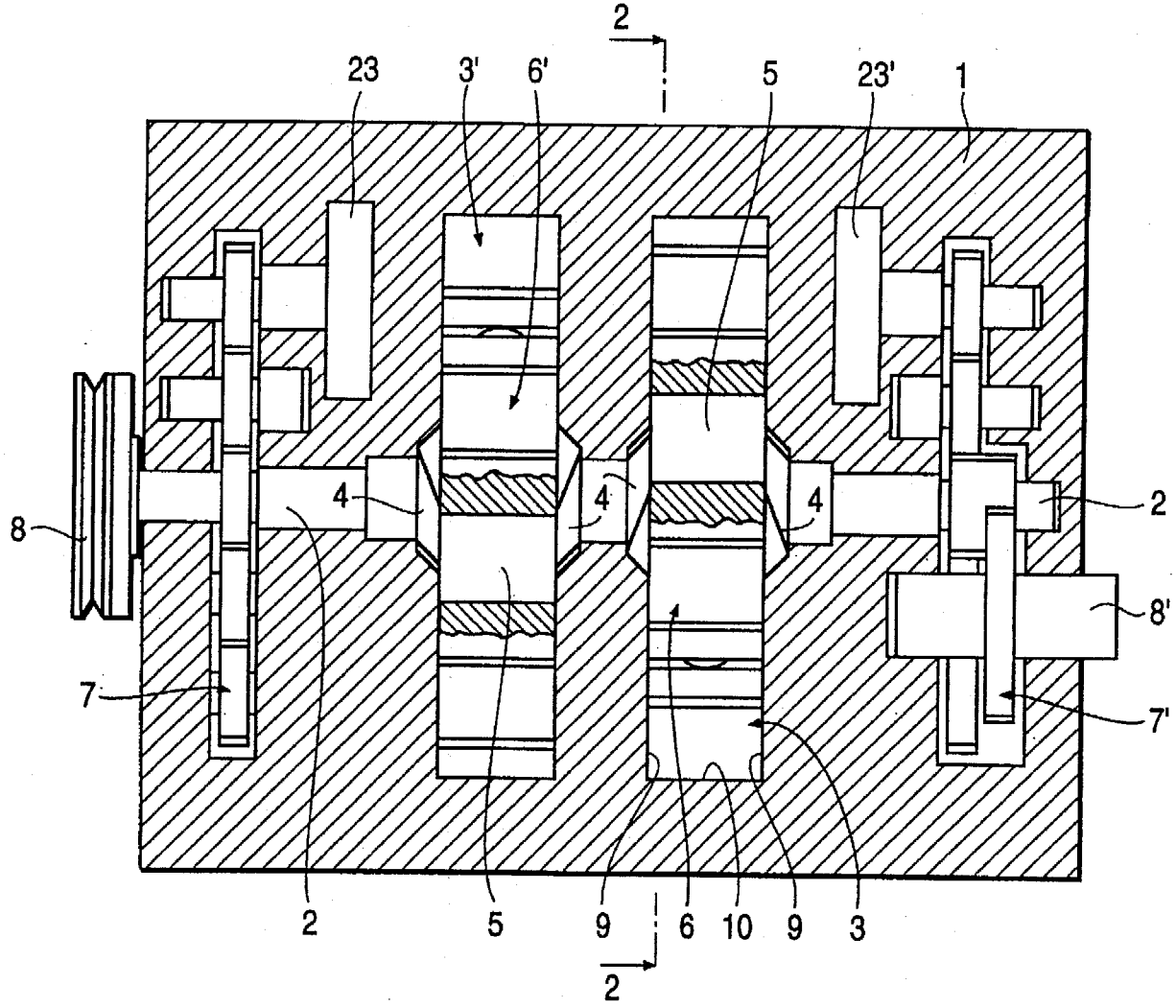
FIG. 1 is a sectional view on the axis of one of the crankshafts on line 1—1 in FIG. 2 of a two-disc combustion machine in accordance with the invention.

The basic construction of the illustrated exemplary embodiment will firstly be described with reference to FIGS. 1, 2 and 3 and, in particular, the enlarged view of FIG. 16. They relate to a combustion machine with a housing 1, which is shown as being of one-piece construction for reasons of simplifying the drawing but which in a practical embodiment should be of multi-piece construction for assembly purposes, for instance divided into plates. Mounted in the housing are two identical, parallel crankshafts 2, 2', of which the crankshaft 2' may be seen in FIG. 3. The crankshafts pass through two working spaces 3, 3', which are arranged behind one another in the manner of discs and of which the working space 3 may be seen open in the sectional view of FIG. 2.

In each working space the crankshafts 2, 2' have cranks 4 on whose crank pins 5 a piston 6, 6' is mounted in each of the working spaces 3, 3'.

Figure 2:
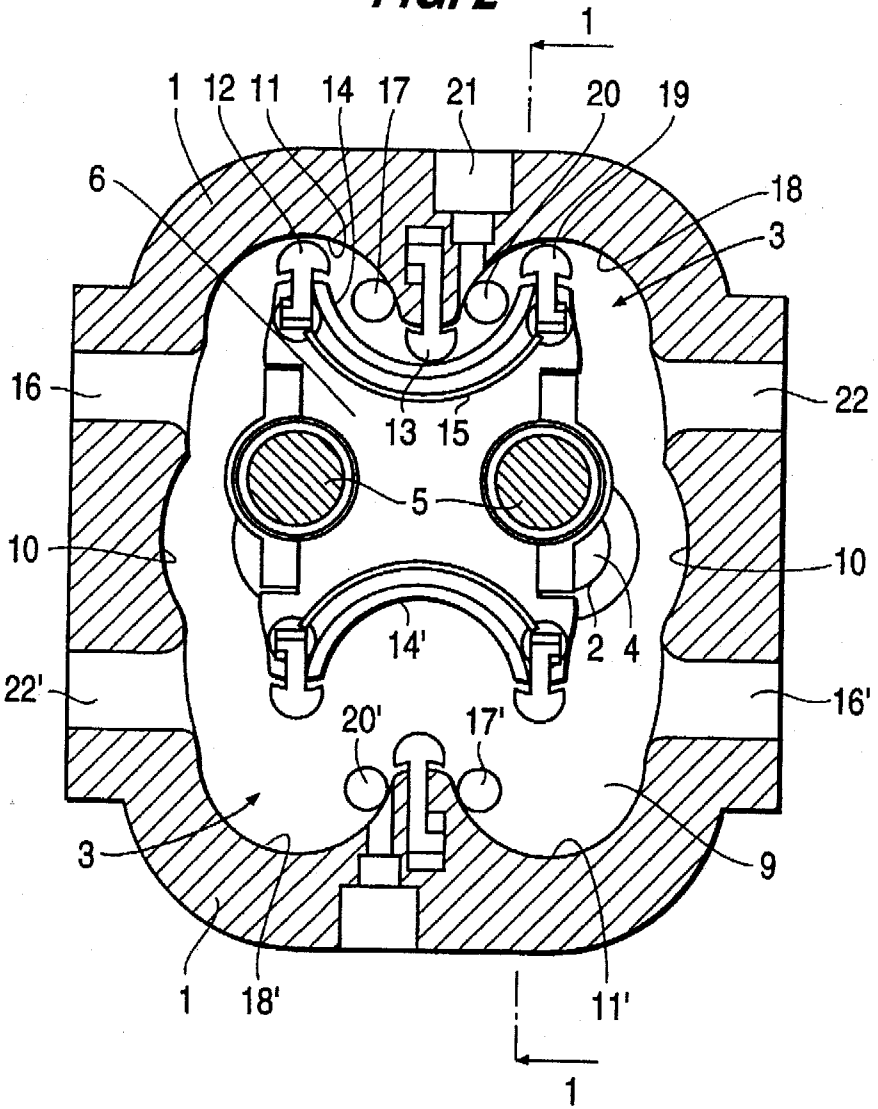
FIG. 2 is a sectional view on the line 2—2 in FIG. 1, FIGS. 3–9 are views similar to FIG. 2 in successive angular positions of the piston.

As shown in FIG. 2, the crankshafts 2, 2' are of identical construction as regards their cranks for the illustrated piston 6, that is to say particularly with the same crank radius and also with the identical angular position. The crankshafts thus rotate in angular synchronism. For this purpose, appropriate gear sets 7, 7' provided with gear teeth are provided at one or both ends of the crankshafts. It may be seen in FIG. 1 that the crankshaft 2 passes through the end wall of the housing 1 at its end adjacent the gear set 7 and there carries a drive pulley 8 provided by way of example. The gear set 7' drives an output shaft 8'.

FIGS. 2 to 9 show that due to the mounting of the piston 6 on the crank pins 5 of the two crankshafts 2, 2', which are angularly synchronously coupled, the piston moves over a rotational path, which is shown in a plurality of successive rotational phases in FIGS. 2 to 9 and can be termed parallel rotation. The piston is positioned in all angular positions of the crankshafts with the axes of the crank pins remaining parallel to themselves throughout all positions of rotation. Each point of the piston performs a rotation with the radius of the cranks 4, but about its own centerpoint. More than two crankshafts can therefore be used to mount a piston, as is shown in a modified embodiment of a piston in FIG. 13 which runs on the crank pins of three angularly synchronously coupled crankshafts.

The construction will firstly be explained further with reference to FIG. 2. The working space 3 is defined by parallel surfaces 9, which extend perpendicular to the crankshafts 2, 2', and by a peripheral wall 10, which extends overall perpendicular to the parallel walls 9.

Provided in the peripheral wall 10 is a sliding surface 11, which is constructed in the shape of a semi-cylinder in the sectional view of FIG. 2, that is to say of semi-circular shape. Arranged at one point on the piston 6 is a sealing strip 12 serving as a sealing element which, during the parallel rotational of the piston 6, as shown in FIGS. 2 to 9, describes a circle, in whose upper half it is in sliding contact with the sliding surface 11.

At the right-hand end of the sliding surface 11 in FIG. 2 a sealing strip 13 is arranged on the peripheral wall 10 serving as a further sealing element. Associated with it is a sliding surface 14 in the piston 6 which is also of semi-cylindrical shape with the same radius as the sliding surface 11. If hypothetical connecting lines are drawn through the end points of the sliding surface 11 and through the end points of the sliding surface 14 and these connecting lines are compared in the rotational phases of FIGS. 2 to 9, it may be seen that these connecting lines always extend parallel to one another.

Figure 3:
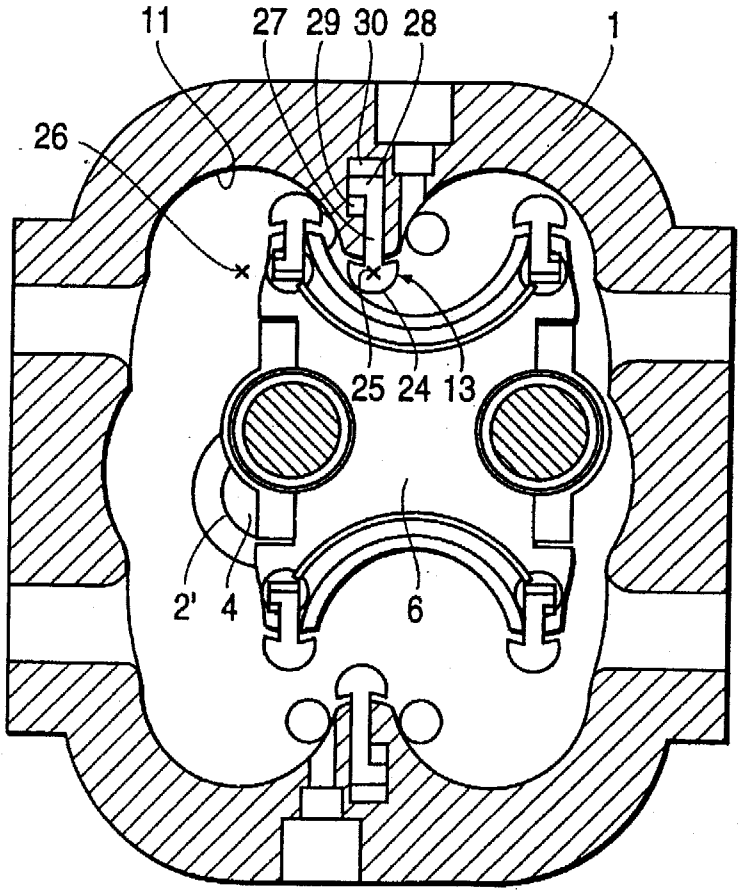
Figure 4:
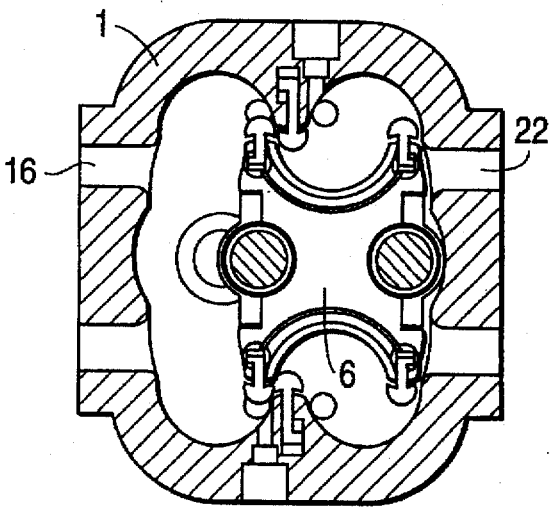
Figure 5:
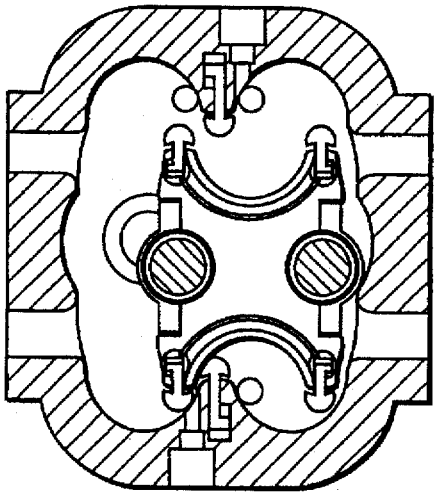
Figure 6:
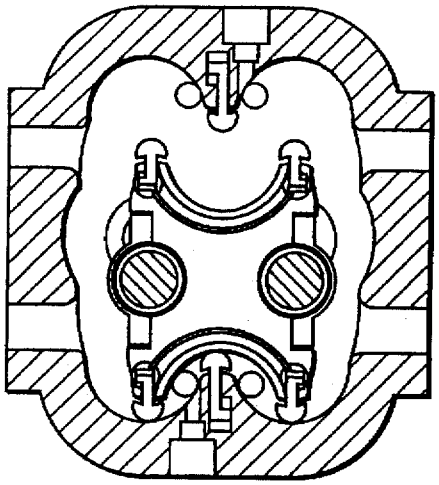
Figure 7:
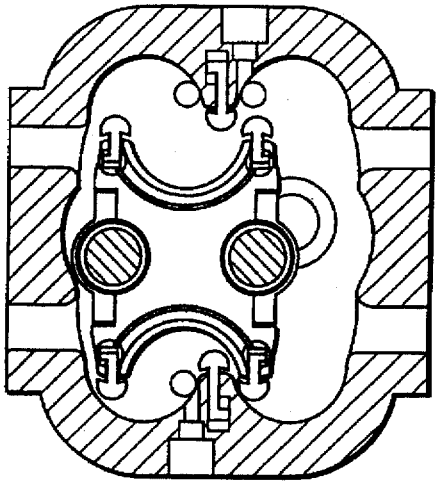
Figure 8:
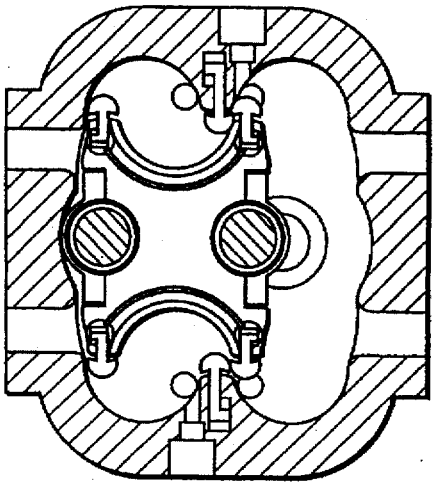
Figure 9:
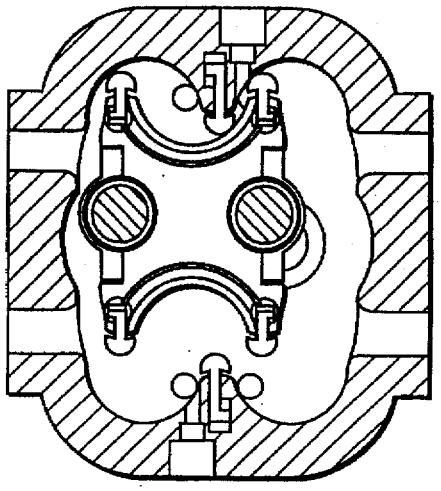

By comparison of the successive phases in FIGS. 2 to 9, one can also see that in the crank angle position of FIG. 8 the sealing strip 12 on the piston 6 comes into engagement with the beginning on the left-hand side in the figures of the sliding surface 11 on the peripheral wall at the same time as the sealing strip 13 comes into engagement with the sliding surface 14 constructed on the piston. The sealing strips 12, 13 then slide (FIGS. 9, 2, 3) on their opposing sliding surfaces 11, 14 to the respective opposite end of the sliding surface until they slide against one another, as shown in FIG. 4. The sealing surfaces then move out of engagement, as shown in FIGS. 5 to 7. Engagement commences again in FIG. 8.

A chamber which is closed on all sides and which is defined by the parallel surfaces 9 and the sliding surfaces 11 and 14 is thus defined between the sliding surfaces 11 and 14. This ° chamber is sealed by the sealing strips 12 and 13 and additionally by lateral sealing strips 15 which are provided in the side surfaces of the piston 6 and arranged in a circular shape and which form a seal with respect to the parallel surfaces 9.

This chamber defined by engagement of the sliding surfaces 11 and 14, which will be referred to below as the chamber 11.14, alters its volume during rotation of the crankshafts 2, 2' in accordance with the sequence of FIGS. 2 to 9, that is to say in the clockwise direction. The chamber 11.14 is open in FIG. 7. It closes at FIG. 8 with maximum volume which is calculated from the spacing of the parallel surfaces 9 and substantially a circular cross-section with the radius of rotation of the cranks 5. If one follows FIGS. 9, 2, 3 and 4, one sees that the chamber 11.14 reduces substantially to zero and then, as shown in FIG. 5, opens again in order to close again at FIG. 8.

In the illustrated direction of rotation of the crankshafts in the clockwise sense the chamber 11.14 is a compression chamber. In the open position (FIGS. 5 to 7) it communicates with working space 3 and can receive gas at low pressure which flows in, for instance, through a low pressure inlet passage 16 in the housing 1. On rotation as shown in FIGS. 8, 9, 2 and 3, the gas in the chamber 11.14 is compressed and finally discharged through a high pressure outlet passage 17, whose opening in the parallel wall is shown in FIGS. 2 to 9, with a substantially increased pressure.

As shown in FIGS. 2 to 9, arranged laterally adjacent the previously described sliding surface 11 in the peripheral wall 10 is a further sliding surface 18 which is of identical construction to the sliding surface 11 mirror symmetrical about the sealing strip 13. The left and right-hand end points of the sliding surfaces 11 and 18 and the common central end point lie on a line. At the end of the sliding surface 14,on the piston 6 opposite to the sealing strip 12 there is a further identical sealing strip 19.

If one compares the rotational phases of the piston 6 as shown in FIGS. 2 to 9, one sees that when the sealing strip 12 slides in the chamber 11.14 on the sliding surface 11 and at the same time the sealing strip 13 slides on the sliding surface 14, the sealing strip 19 is always in engagement with the sliding surface 18 and moves along it. At the same time as the chamber 11.14, a chamber is defined, which is termed chamber 18.14 with the same terminology but which experiences a change in volume in the reverse direction to the chamber 11.14. When the chamber 11.14 reduces its volume on rotation of the piston 6, the volume of the chamber 18.14 increases at the same time. The chamber 18.14 therefore constitutes an expansion chamber which initially (FIGS. 5 to 7) is open, begins with minimum volume at FIG. 8 and then increases its volume to the maximum volume at FIG. 4 in order then (FIG. 5) to open and to close again at FIG. 8.

A high pressure inlet passage 20 also communicates with the chamber 18.14 which, however, in contrast to the high pressure outlet passage 17, is not provided to discharge compressed gas but for the inlet of compressed gas which is decompressed during the working cycle of the chamber 18.14.

The construction as described thus far can be used as a combustion machine which clearly operates on the one-stroke principle since it requires only 180° of crankshaft angle for a complete working cycle.

Air flowing in through the low pressure inlet passage 16 is trapped in the chamber 11.14, compressed and supplied through the high pressure outlet passage 17 to a pressure reservoir, which is not shown. The compressed air is supplied from the latter through the high pressure inlet passage 20 at a time of low chamber volume of the chamber 18.14 or through the high pressure inlet passage 20' to the chamber 18'.14' and caused to explode there. For this purpose, a fuel, e.g. petrol or diesel fuel, is supplied with injection devices, which are not shown, e.g. in the form of suction tube injection into the high pressure inlet passage or in the form of direct injection directly into the chamber. A spark plug or injection nozzle can be arranged in the illustrated stepped bore 21. After expansion and opening of the chamber 18.14 the combusted gas can escape out of a low pressure outlet passage 22 opposite to the low pressure inlet passage 16.

In a simpler embodiment differing from the arrangement illustrated in FIG. 2, the expansion chamber 18.14 and the compression chamber 11'.14' can, for instance, be omitted. A compression chamber 11.14 and an expansion chamber 18'.14', which can work together in the manner described above, are then still always present.

The combustion machine can also operate on the diesel principle. An injection nozzle should then be provided in the stepped bore 21 which injects fuel into the compressed air supplied to the chamber 18.14 at the time of low chamber volume. Since very large changes in volume may be achieved with the illustrated chambers 11.14 and 18.14, air can be raised to the necessary pressure of, for instance, 30–60 bar with the chamber 11.14 without difficulty.

As shown in FIG. 2, the high pressure passages 17 and 20 are disposed in the immediate vicinity of the sealing strip 13, which is situated between the chambers 11.14 and 18.14 and is provided on the peripheral wall 10, that is to say in the region of minimum chamber volume. The low pressure passages 16 and 22, which serve as an inlet and an outlet, are situated opposite to one another in the region in which the associated chambers 11.14 and 18.14 receive and discharge gas, respectively. Scavenging from the low pressure inlet passage 16 to the low pressure outlet passage 22 is promoted by the rotation of the piston 6 in the clockwise sense so that mixing of fresh and exhaust gas is prevented.

The high pressure passages 17 and 20 must have valves which, in the case of the compression chamber 11.14, must open to discharge the high pressure gas and, in the case of the expansion chamber 18.14, must close after admission of the high pressure gas. For this purpose, valves can be provided which are controlled in synchronism with the rotation of the crankshafts 2, 2'. In the illustrated exemplary embodiment rotary slide valves 23, 23' are shown in FIG. 1 which are driven by the respective gear sets 7, 7' in synchronism with the crankshafts and control the high pressure passages, which are not visible in the sectional view of FIG. 1. In the case of a compression chamber, one-way valves can be provided for this purpose which permit flow in the gas direction and which are constructed, for instance, as spring-loaded flap valves.

The construction of the sealing strips 12, 13 and 19 will be described with reference to FIG. 3 and, in particular, FIG. 16. They are of substantially identical construction and will be described in detail by way of the example of the sealing strip 13.

The sealing strip 13 has a surface 24 of circular cross-section whose center 25 is situated at a radius from the center 26 of the sliding surface 11 which corresponds to the radius of the cranks 5 of the crankshafts 2, 2'. The radius of the surface 24 of the sealing strip 13, with respect to its center 25, must be added to the radius of rotation of the cranks 5 in order to produce the radius of the sliding surface 11, with respect to its center 26. The radius of the sliding surface 14 of the piston is identical to that of the sliding surface 11. The same applies to the sliding surface 18 described above. During sliding of the sealing strips on their respective opposing sliding surfaces, that is to say of the sealing strip 12 on the opposing sliding surface 11, sealing strip 13 on opposing sliding surface 14 and sealing strip 19 on opposing sliding surface 18, it can be seen from the sequence of FIGS. 2 to 9 that the sealing strips move across the opposing sliding surfaces with a constantly changing line of contact which produces an envelope curve of the rotation of a sealing strip during parallel rotation of the piston 6.

Figure 16:
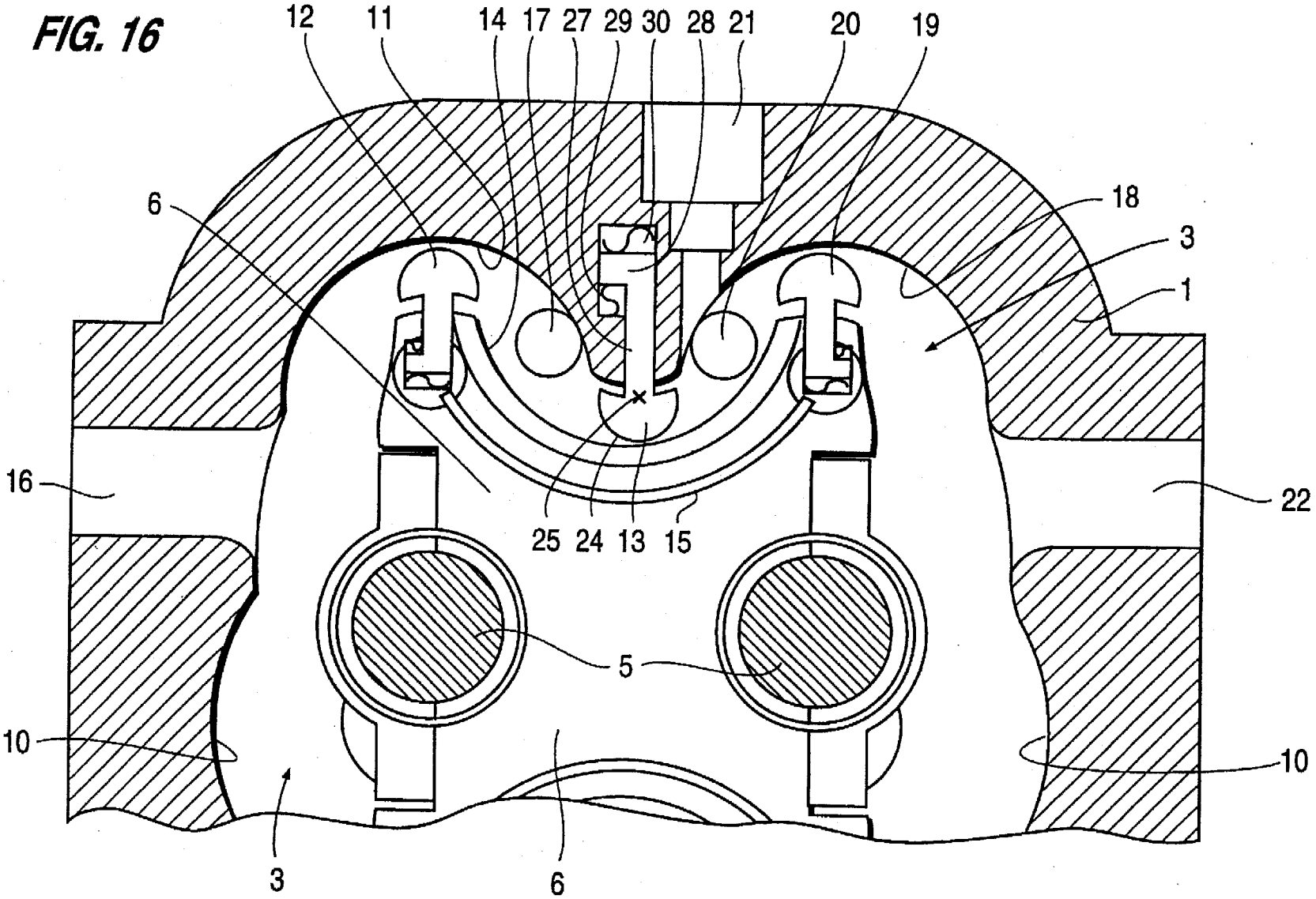
FIG. 16 is an enlarged view for the purpose of clarity of the upper portion of FIG. 2.

The sealing strips 12, 13 and 19, the construction of which is substantially identical, are, as in FIGS. 3 and 16 and described by way of the example of sealing strip 13, slidably mounted with a slider 27 in a slide guide and constitute a piston 28 at their end opposed to the surface 14 which slides in a cylinder with spaces 29 and 30. Provided in the two spaces 29 and 30 are springs (indicated schematically in FIG. 16 with wavy lines) which act on the piston 28 from above and below and which hold the sealing strip in a. defined central position. The space 30 situated outside the piston 28 can, in a preferred embodiment, be connected by means of a bore, which is not shown, to one of the adjacent chambers in order that high pressure gas from it acts therein which presses the sealing strip with an additional biassing force into sealing engagement with its sliding surface. Such a bore 100 is shown in chain lines in FIG. 17. It serves to gas load the sealing strip 120.

The construction described thus far is operable as a combustion machine with a compression chamber 11.14 and expansion chamber 18.14. However, an exemplary embodiment is illustrated in FIGS. 1 to 9 in which this chamber arrangement is provided in duplicate, in symmetrical positions with respect to the crankshafts 2, 2'. Symmetrically opposed to the chambers 11.14 and 18.14, described above, with respect to the crankshafts 2, 2' are two chambers which are designated with identical reference numerals, provided in each case with a prime. The position of the sliding surfaces 11' and 18' is, as shown in FIG. 2, transposed with respect to the sliding surfaces 11 and 18 since, corresponding to the direction of rotation of the piston 6 in the clockwise sense, the chamber 11'.14' is a compression chamber corresponding to the chamber 11.14 while the chamber 18'.14' is an expansion chamber. The position of the supply and discharge low pressure passages 16', 22' and of the high pressure passages 17' and 20' should also be transposed accordingly.

The construction illustrated overall in FIGS. 1 to 9 thus constitutes a combustion machine which has two compression chambers and two expansion chambers per disc, that is to say four compression and four expansion chambers in all. As shown in FIG. 1, the cranks 4 of the crankshafts are angularly offset from one another in the working spaces 3 and 3'. The pistons 6, 6' thus operate with a phase displacement. The result of this can, for instance, be that the compression chambers of one disc discharge high pressure gas at a time at which the expansion chambers of the other disc require high pressure gas.

A combustion machine can also have more than the two illustrated discs in an embodiment which is not illustrated.

Figure 10:
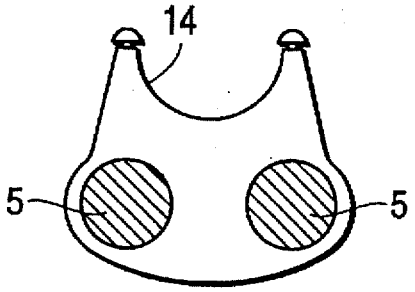
FIGS. 10–15 are elevations corresponding to FIG. 2 of various piston modifications of different embodiments.

In an embodiment which is not illustrated, only one double chamber arrangement with chambers 11.14 and 18.14 can, for instance, be provided in one disc. A corresponding piston with only one sliding surface 14 is shown in FIG. 10. In a further simplified embodiment only one opposing sliding surface, for instance the sliding surface 11 in the peripheral wall 10, can be provided for the piston illustrated in FIG. 10 with only one sliding surface 14. It is then a pure compressor which must be driven by an external source and which has only one compression chamber per disc. In a corresponding embodiment, as shown in FIG. 2, such a pure compressor can also have two compression chambers (but no expansion chambers) per disc.

In another embodiment, only expansion chambers, for instance, can be provided in one disc and only compression chambers in another disc. As these few examples show, the invention offers considerable scope for variation.

Thus, for instance, a compressor with its own motor can be so constructed that, for instance, an expansion chamber is provided in only one disc in the two discs illustrated in FIG. 1, which expansion chamber drives the compressor on the combustion machine principle but each disc has two compression chambers. Calculations indicate that one expansion chamber is sufficient to drive four compression chambers.

Figure 13:
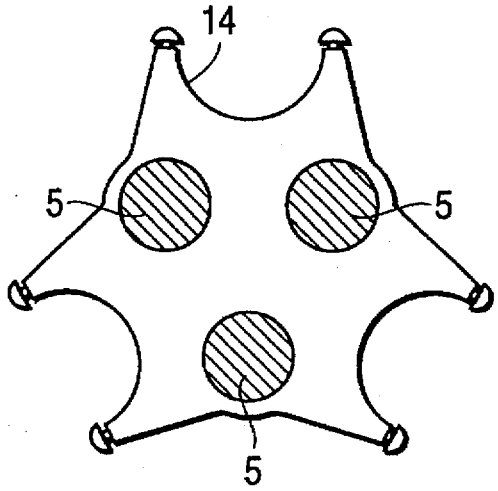
Figure 14:
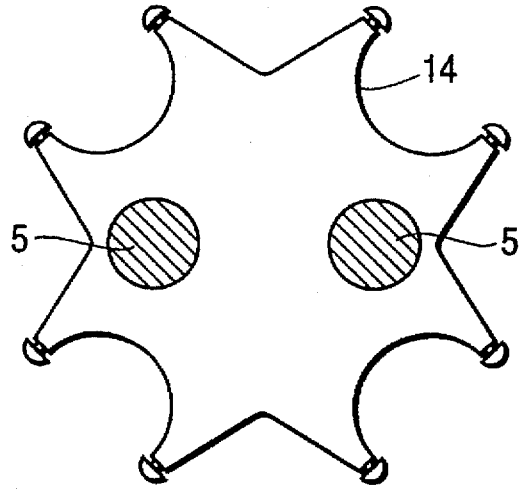
Figure 15:
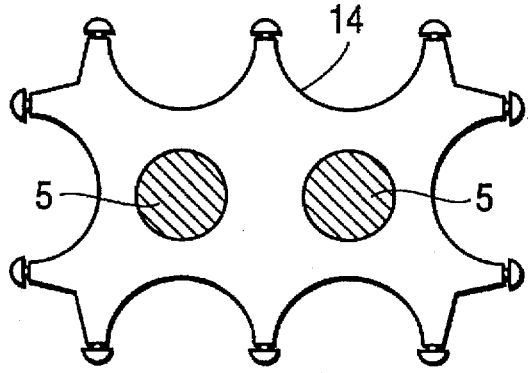

More than two chamber arrangements can also be provided at the periphery of a working space, each of which can comprise either an expansion chamber or a compression chamber or an expansion and a compression chamber. This is shown in the views of FIGS. 13 to 15.

Figure 11:
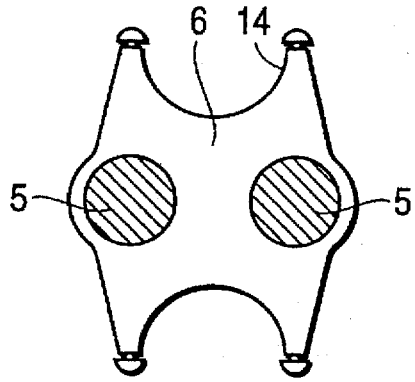

FIG. 10 shows a piston with only one sliding surface 14 with which a single or double chamber arrangement may be provided. FIG. 13 shows a piston with three sliding surfaces for three such chamber arrangements. FIG. 11 shows, for comparison, the piston described in FIGS. 1 to 9 for two such chamber arrangements.

Figure 12:
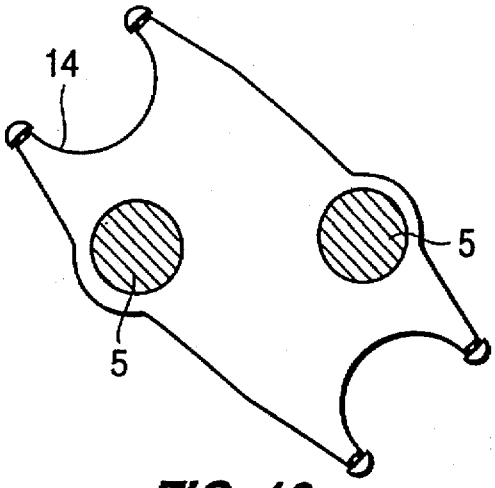

FIG. 12 shows a piston with two sliding surfaces which, however, in comparison with FIG. 11, are arranged obliquely to the line connecting the crankshafts. FIGS. 14 and 15 show that larger numbers of chamber arrangements are possible without difficulty. The geometrical conditions must be taken account of merely from the point of view of space requirements. The parallel rotational movement of the piston makes substantially any desired number of chamber arrangements per piston possible.

It should also be noted in the embodiment of FIG. 12 that the forces exerted in it from the sliding surfaces 14, 14' on the piston onto the crank pins 5' act at a different angle than in the embodiment of FIGS. 2 to 9 and 11. This can also be achieved in a different manner.

Thus in the embodiment illustrated in FIG. 2, the chamber arrangement with the chambers 11.14 and 18.14 can be arranged tilted obliquely with respect to the line connecting the crankshafts 2, 2'. The line connecting the sealing strips 12 and 19 on the piston 6 then also extends obliquely to the line connecting the crankshafts 2, 2'. The sliding surfaces 11 and 14 should then be arranged correspondingly obliquely tilted such that the line connecting their end points extends parallel to the line connecting the sealing strips 12 and 19 on the piston 6. The introduction of the forces arising in the chambers into the cranks may be arranged at optimum angles in this manner also.

The same effect of a more favorable introduction of forces into the cranks may also be achieved by increasing the spacing of the crankshafts while otherwise maintaining the geometry of the chambers.

Figure 17:
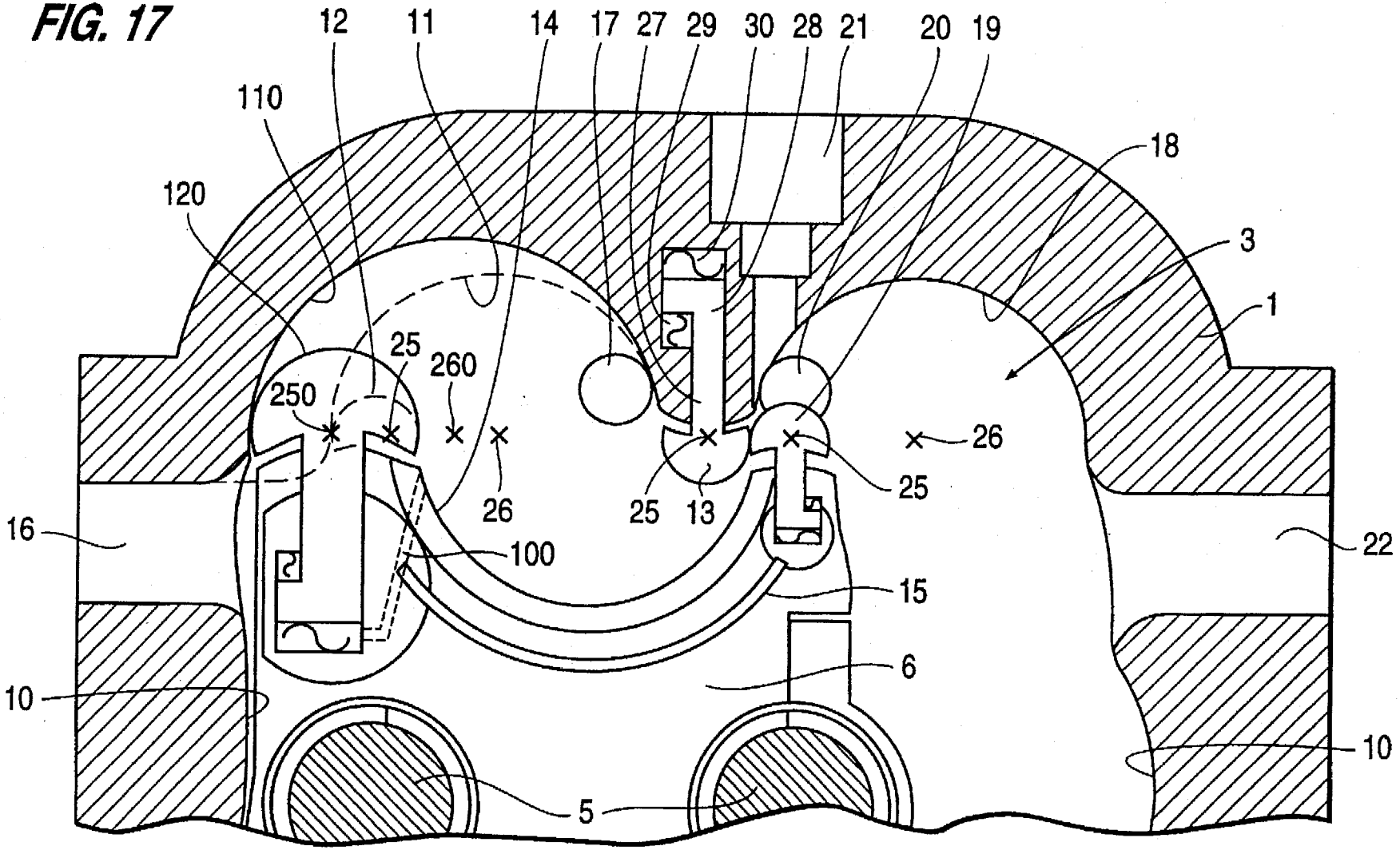
FIG. 17 is a view corresponding to FIG. 16 of a modified embodiment with sealing strips of different size.

FIG. 17 shows a modified embodiment whose differences to the construction described above may be seen by comparison with FIG. 16. The same components are provided with the same reference numerals.

In distinction from the embodiment illustrated in FIG. 16, the sealing strip 120 situated at the left-hand end of the sliding surface on piston 6 is of considerably increased size, as is shown by comparison with the sealing strip 12 in the construction of FIG. 16. In the exemplary embodiment its radius, that is to say its overall dimensions, is doubled.

The left-hand stationary sliding surface 110 is of correspondingly increased size with respect to the sliding surface 11, shown in chain lines, which corresponds to that of the construction of FIG. 16. The center of the original sliding surface 11 was situated at 26. The center of the new sliding surface 110 is situated at 260. As may be seen, the increase in size is asymmetrical to the left, as is shown by the lateral displacement of the centers 26 and 260. The result of this is that the sealing strip 120 not only has a radius which is twice as large but also its center is laterally offset accordingly from 25 to 250. The result of this is a shape of the new sliding surface 110 which is extended to the left and upwards but at the right-hand end towards the sealing strip 13 merges into the original sliding surface 11.

In other respects the construction is completely unaltered, that is to say in particular as regards the overall geometry of the crankshafts, of the piston 6, of its sliding surface 14 and of the sliding surface 18 of the stationary chamber 18.14 situated on the right-hand side.

The newly formed chamber 110.14 of increased size is distinguished by comparison with the original construction of FIG. 16 by a maximum volume which is increased in the exemplary embodiment by 25% and by a correspondingly increased maximum compression ratio. In other respects the mode of operation of the overall construction is unaltered. The working cycle in the individual phases corresponding to FIGS. 2 to 9 is unaltered.

The enlarged sealing strip 120 can be constructed with other dimensions differing from the sealing strips 13 and 19, for instance even larger, or somewhat smaller. The periphery of the new sliding surface 110 should be adapted accordingly.

It is possible with this construction to construct the two chambers of the double chamber arrangement 18.14, 110.14 of different sizes without altering the remaining geometry. If the arrangement is provided mirror symmetrically with a right/left transposition, that is to say with an enlarged sealing strip 19, the right-hand chamber would be larger than the left-hand one. It is of course also possible to construct two sealing strips 120 and 19 on the piston 6 differently from the sealing strip 13, which is static on the peripheral wall 10, either with the two the same or differing from one another. The sealing surface 14 on the piston would then remain unaltered. The two static sealing surfaces 11 and 18 should however then be altered accordingly.

Figure 18:
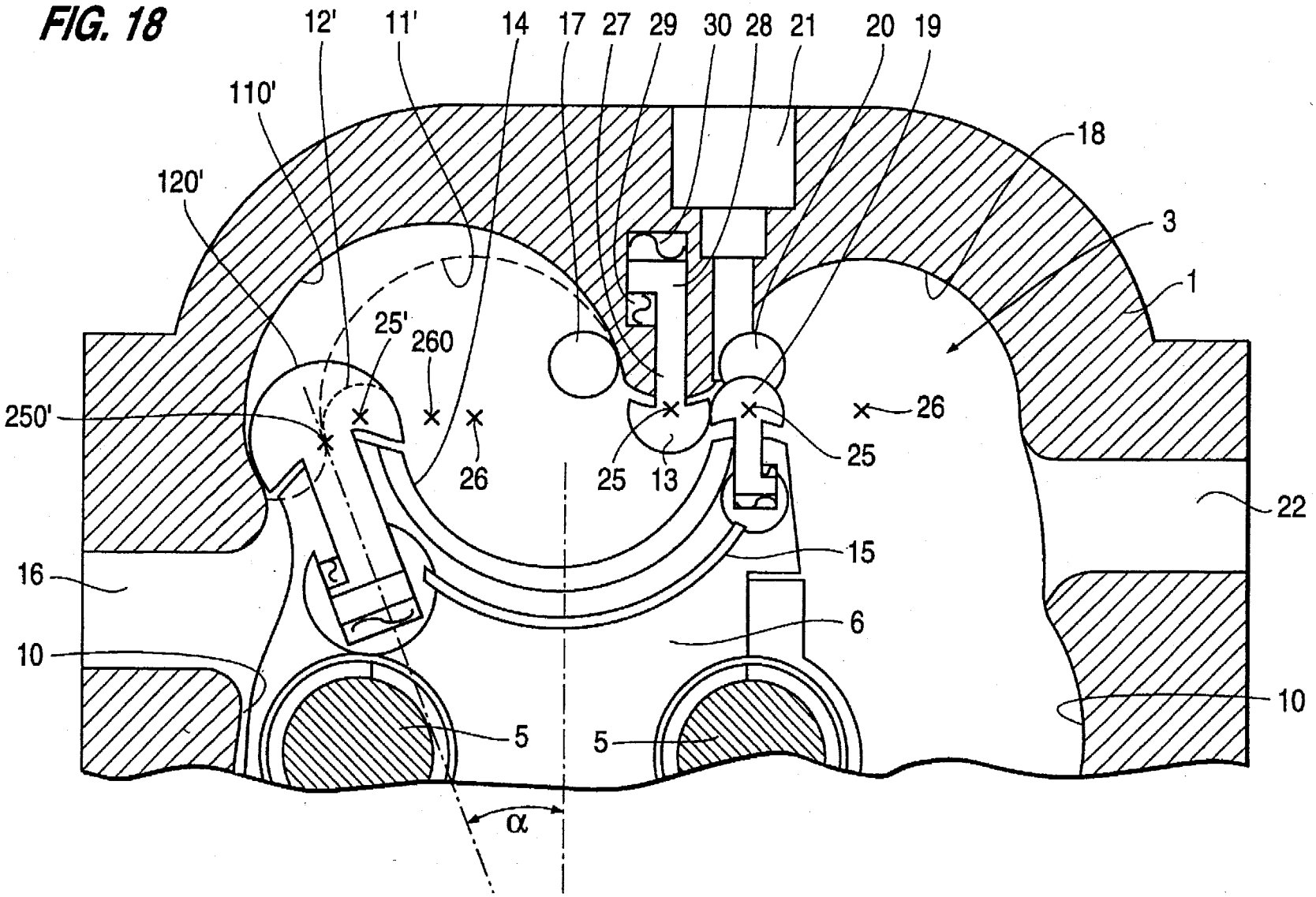
FIG. 18 is a view corresponding to FIG. 17 with an obliquely positioned sealing strip.

FIG. 18 is a similar view of a modification of the construction of FIG. 17. Similar parts are provided with the same reference numerals. The reference numerals of altered parts have also been retained, but provided with a prime.

As may immediately be seen, the alteration relates to the sealing strip 120' positioned at the left-hand end of the chamber 110'.14, that is to say at the left-hand end of the sliding surface 14 on the piston 6.

If one considers the enlarged sealing strip 120 in FIG. 17 again for comparative purposes, one sees that its plane of symmetry lies precisely parallel to the plane of symmetry of the sliding surface 14 adjacent to it, as with the sealing strip 25 situated at the right-hand end of the sliding surface 14 on the piston. The result of this is, as shown in FIG. 17, a maximum peripheral angle of the opposed sliding surface 110 on the chamber of about 180°. In the case of the smaller sealing strip 12 also, which is shown in chain lines, the corresponding smaller opposed sliding surface 11 can be contacted only over about 180°. The maximum chamber size, which is shown in FIG. 17, is thereby limited.

It is illustrated in FIG. 18 that the plane of symmetry, which is shown in chain-dotted lines, of the enlarged sealing strip 120' therein is arranged at an oblique angle $\alpha$ with respect to the plane of symmetry, which is also shown in chain-dotted lines, of the sliding surface 14 adjacent to it. The comparison with FIG. 17 reveals also that the circular sector surface of the sealing strip 120' extends over a somewhat larger angular range. This results in the possibility of guiding the sealing strip 120' over an angular range, also increased by $\alpha$, in excess of 180° in engagement with the correspondingly lengthened opposing sliding surface 110'. The maximum chamber volume can thereby be again considerably increased, as is shown by the comparison of FIGS. 17 and 18, without altering the crankshafts.

In particular, as shown in FIG. 18, the left-hand chamber 110'.14 can again be considerably increased in size while the right-hand chamber 18.14 is maintained small since the sealing strip 25 is arranged in it at 90° and furthermore has a substantially smaller surface area of its circular sector.

The smaller sealing strip 12' is also shown (in chain lines) in FIG. 18 within the enlarged sealing strip 120' at the same angle. The result of this also is a correspondingly enlarged opposing sliding surface 11' with a corresponding increase in size of the chamber due to the different angular arrangement.

Figure 19:
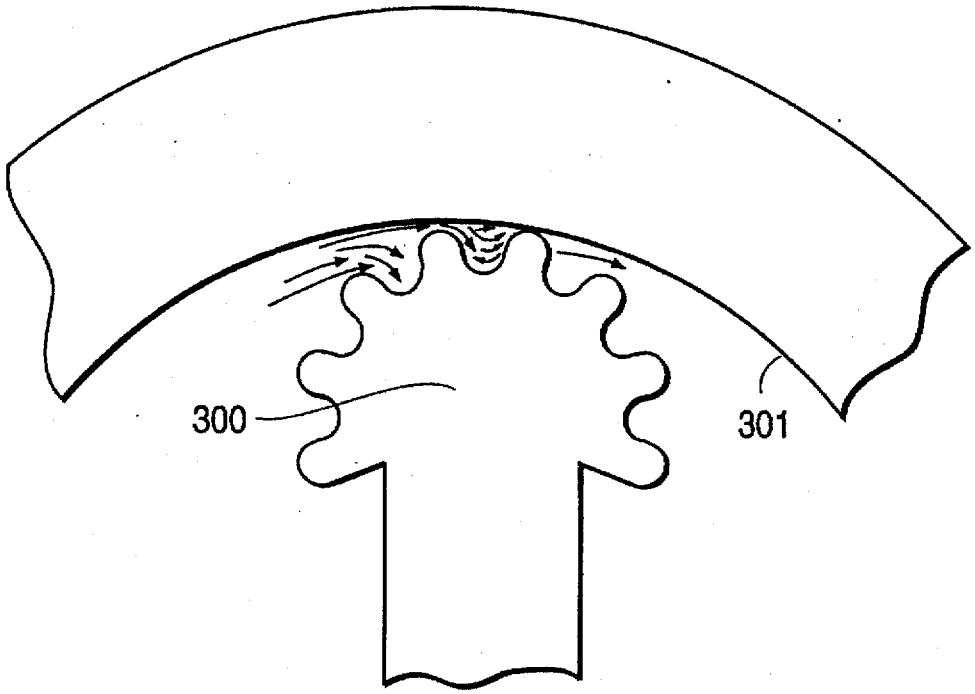
FIG. 19 is a schematic sectional view of a sealing strip with a toothed surface in engagement with its opposed sliding surface.

FIG. 19 is a sectional view of a sealing strip 300 whose basic construction corresponds to the embodiment of the sealing strips 12 or 120. Its surface is, however, of ribbed construction, wherein these ribs extend in the longitudinal direction of the sealing strip 300 and can be of more or less fine construction with a corresponding number of ribs. The sealing strip 300 runs on its opposing sliding surface 301.

In the illustrated case, a chamber at high pressure is situated on the left-hand side of the sealing strip 300. In the event of leakage, for instance due to lifting away of the sealing strip 300 from the opposed sliding surface 301, the gas thus flows in the direction of the illustrated arrows through a gap between the sealing strip 300 and the opposed sliding surface 301. This results in compression losses.

However, the leakage gas current flowing in the direction of the arrows is substantially impeded by the ribbed surface of the sealing strip 300 since as a result of the ribbed surface it must flow over valleys and ridges of the ribs. Turbulence occurs in the valleys and thus also a braking of the gas flow and consequently an increase of the flow resistance of the gap defined between the sealing strip 300 and the opposing sliding surface 301. The seal is thus improved if the sealing strip lifts away.

Additionally or alternatively, the seal of a sealing strip can also be improved, particularly with sealing strips with a flat surface, that is to say, for instance, a sealing strip 120 in FIG. 17, if the lifting away is prevented in some other manner. Lifting away generally occurs when the sealing strip oscillates or chatters in its resilient mounting during disturbances to the smooth movement. Such oscillating movements can be suppressed by damping. For this purpose, damping devices, e.g. hydraulic damping devices in the manner of conventional hydraulic piston shock absorbers, can be provided in the resilient bearing mounting of a sealing strip.

Figure 20:
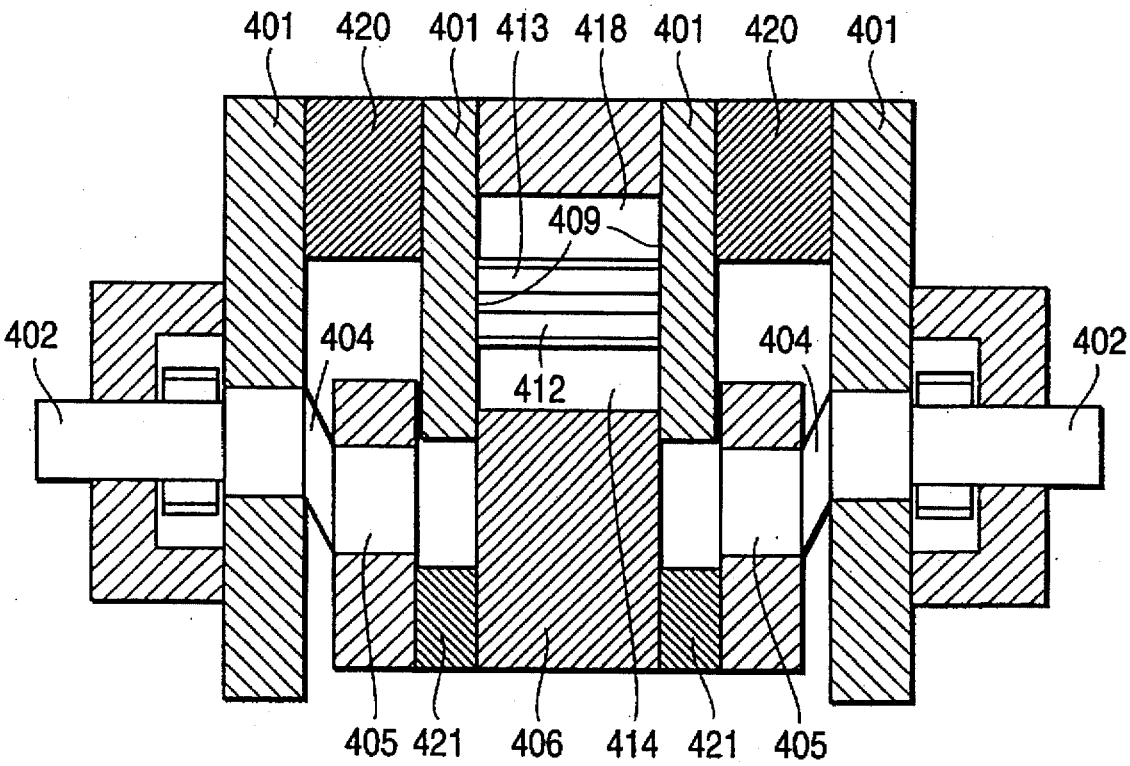
FIG. 20 is a sectional view in the sectional direction of FIG. 1 of a modified embodiment of a piston machine with a working space having a chamber arrangement and thermal insulation on the crankshaft bearings.

FIG. 20 shows a modified construction of a piston machine whose basic construction will initially be described by comparison with the construction of FIGS. 1 and 2.

The construction shown in FIG. 20 is illustrated in longitudinal section, that is to say in a section corresponding to FIG. 1. The construction has only one working space with a piston 406 with a sliding surface 414 and sealing strip 412 (compare FIG. 2). The portion of a sliding surface 418 with a stationary sealing strip 413 may be seen in section at the periphery of the working space. The chamber is open. The piston is thus approximately in the position shown in FIG. 5. In contrast to the piston of FIGS. 1 and 2, the piston 406 of the construction of FIG. 20 affords only one sliding surface on its upper surface (like the piston of FIG. 10). All the other piston shapes, such as those of FIGS. 11–15, are, however, also possible.

The piston 406 operates between the parallel walls 409 of the working space in a housing 401. This has bearings, spaced in each case from the working space, for crankshafts 402, which have crank pins 405 connected via cranks 404, on which crank pins the piston 406 is mounted with spaced portions.

The construction substantially corresponds to the basic construction of FIG. 1 in a single disc construction, that is to say with only one working space and only one piston. The bearings of the crankshaft in the housing 401 and of the piston 406 on the crank pins 405 are, however, each provided spaced from the working space and from the piston.

Between the working space 418, 413, 409 and the bearings on the crankshaft 402, the housing 401 has interposed portions 420 through which heat produced in the working space must be conducted in order to reach the crankshaft bearings. These portions 420 can, as shown in FIG. 2, be of very long construction, whereby the flow of heat is prevented. Cooling devices, such as internal cooling passages, can be provided at this position or cooling ribs for air cooling purposes can be provided on the surface in order to reduce the heat transfer from the working space to the bearings in this manner. Furthermore, the portions 420 can, for instance, be of heat-insulating construction. The heat transfer from the thermally loaded working space to the crankshaft bearings can be drastically reduced with one or more of these possibilities. They can thus be provided as simple ball bearings with permanent lubrication which require no particular cooling, as is otherwise necessary with crankshaft bearings of combustion machines or compressors for or reasons of thermal loading.

These considerations apply also to the bearings of the piston 406 on the crank pins 405. In this case also interposed portions 421 are provided between the piston 406 and its bearing points through which the heat from the thermally loaded piston 406, that is to say from its thermally loaded sliding surface 414, to the bearing points is conducted to the crank pins 405. These interposed portions 421 can be provided with cooling devices in a manner corresponding to the portions 420 of the motor housing 401, for instance with air cooling ribs or a heat insulating construction. Ball bearings can then also be provided on the crank pins 405 without the conventional lubricant cooling. The motor construction may be considerably simplified by omitting a corresponding cooling circuit.

Heat dissipation can naturally be taken care of in other manners in piston machines with highly thermally loaded chambers, for instance by water cooling passages in the housing in the vicinity of the sliding surfaces provided thereon and by liquid cooling of the piston, which can be effected, for instance, with oil passages in the piston which are connected to the two crankshafts via the bearings. Air cooling of the housing is, however, also possible, for instance by virtue of external ribbing. The piston can also be satisfactorily cooled with gas cooling alone.

If one considers, for instance, the piston illustrated in FIG. 2, one sees that it constantly rotates in the working space and is thus in intensive gas contact with the cool fresh gas which is constantly flowing in. If the piston is substantially ribbed outside its sliding surfaces 14 and 14', for instance on its surface, adequate gas cooling of the piston can be effected thereby. The piston can also be provided with openings, for instance (see FIG. 2) an opening which extends approximately on a theoretical line between the openings 16 and 20 in the housing 1 and passes through the upper portion of the piston 6 between its sliding surface 14 and the bearings on the cranks 5 and through which air flows during rotation of the piston.

A further possibility for constructional simplification will be described with reference to FIG. 20. If the crankshaft 402 shown on the right-hand side of FIG. 20 is completely omitted, the piston 406 is mounted with respect to the housing 401 only on the crankshaft 402 illustrated on the left-hand side. It should be taken into account that in accordance with the constructional principle of this piston machine, as shown by the views of FIGS. 10 to 15, the piston is always mounted on each side on two or more cranks, of which only one is shown in section in FIG. 20. Mounting on one side on two or more cranks can, however, under certain circumstances be sufficient for the precise mounting of the piston, whereby the construction can be substantially simplified.

For this purpose, however, the distance between the piston and its mounting on the crank pin should be maintained as short as possible or the piston should be mounted directly on the crank pin and the piston should have adequate lateral guiding at the parallel surfaces of its working space, as shown in FIG. 1. If the construction shown in FIG. 1 is split along the section line 2—2, the piston situated in the portion of the construction remaining on the left-hand side could run even if mounted on one side on two crankshafts with sufficiently precise guiding.

In FIGS. 1–19 the sealing elements, which define a chamber, are illustrated as always being substantially smaller than the crank radius of the piston. In the embodiment of FIG. 17, the sealing strips 13 and 19, for instance, have a surface radius which is about one quarter of the crank radius. The larger sealing strip 120 has a surface radius which is about half as large as the crank radius. The sealing strips are always resiliently mounted in the previously described embodiments, as is shown also in FIG. 17.

In distinction to these embodiments, the sealing elements can be constructed with substantially larger surfaces, by comparison with the crank radius, and they can also be constructed without springs as rigid components of the piston or in the cylinder wall. This is illustrated in an example in FIG. 21.

Figure 21:
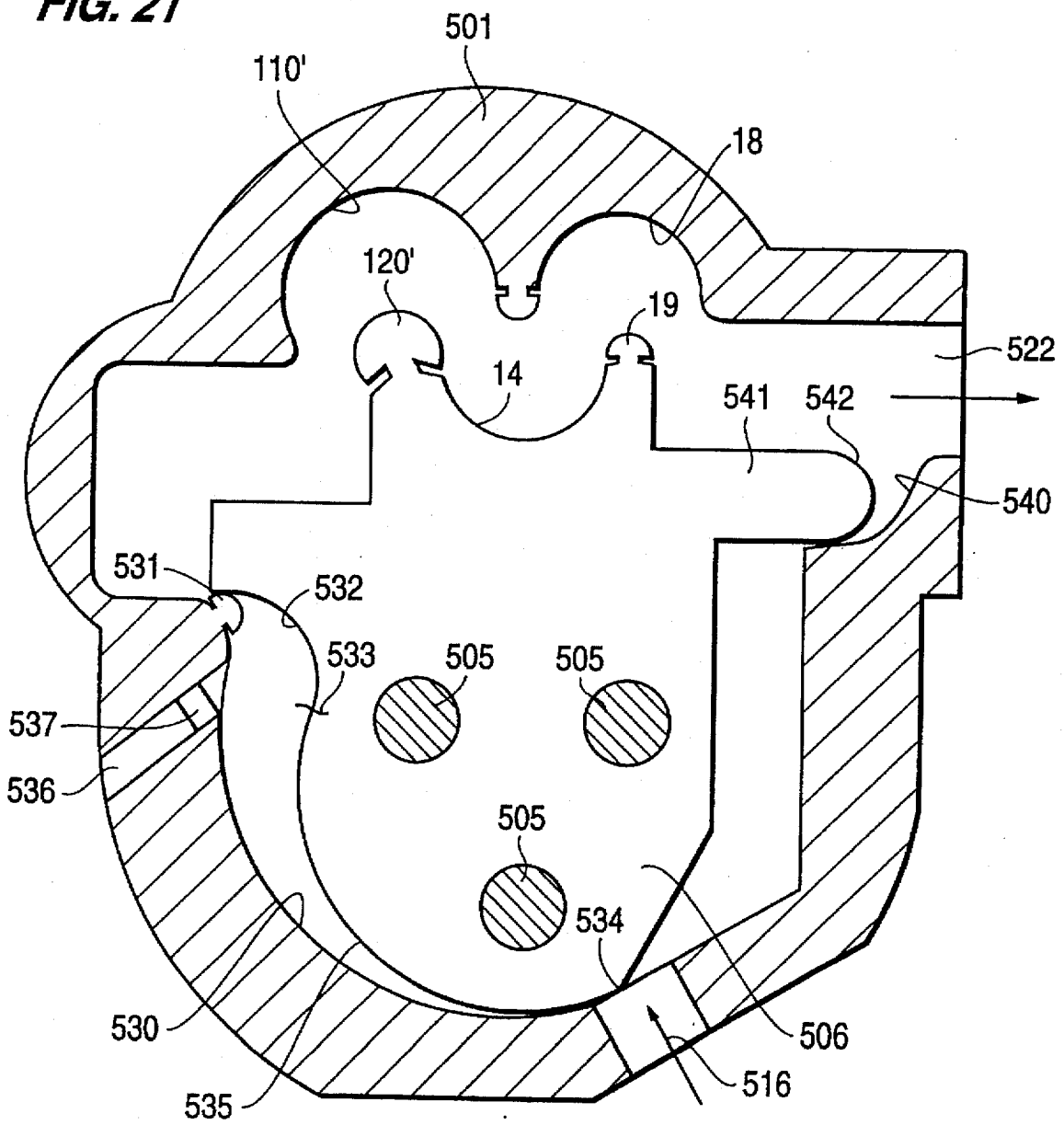
FIG. 21 is a sectional view corresponding to FIG. 2 of a piston machine with two smaller pistons and one very large one.

FIG. 21 is a sectional view transverse to the crankshafts of a housing 501 in which a piston 506 is mounted for parallel rotation on crank pins 505 on three crankshafts. Defined on the peripheral wall of the illustrated working space is a very large sliding surface 530 which has the sectional shape of a section of a circle and at one end of which a sealing strip 531 of small cross-section is mounted on the housing. Provided on the piston 506 is a sliding surface 532 which serves as an opposing sliding surface for the sealing strip 531. It extends from the corner at the position of the sealing strip 531 to the peripheral point marked with a line 533, that is to say over nearly 180°. It is adjacent to a portion of the piston 506 which is of circular shape, namely between the marking line 533 and the corner 534. This circular section surface portion of the piston constitutes the sealing element 535 which runs over the sliding surface 530 on parallel rotation of the piston 506, that is to say on parallel rotation of the piston 506 in the clockwise direction between the beginning of the sliding surface 530 at the low pressure inlet passage 516 to the end of the sliding surface 530 at the sealing strip 531.

A working chamber 530.532 is thus defined which is bounded by the sliding surfaces 530 and 532 and by the sealing elements 531 and 535. During the parallel rotation the sealing element 535 runs over the sliding surface 530 while defining a chamber while the sealing strip 531 runs over the sliding surface 532. The same chamber forming conditions are present as were described in connection with the preceding embodiments. In distinction thereto, merely the ratio of the surfaces of the sealing elements is selected to be very large and the sealing element 535 has a surface radius which is very much larger than the crank radius. Furthermore, the sealing element 535 is not resiliently supported in this embodiment. It can thus only form a seal with respect to its opposing sliding surface 530 with a necessary gap determined by the clearance. The chamber 530.532 is thus usable substantially only as a low pressure compression chamber but has a very large chamber volume and can thus be used to compress large volumes of air to low pressures.

When using this chamber 530.532 as a compression chamber, the compressed gas can be obtained through an outlet passage 536 with a valve 537.

In the embodiment of FIG. 21 the chamber 530.532 is combined with the two chambers 110.114 and 18.14 of the embodiment of FIG. 18. The sliding surface 14, at whose two ends the sealing strips 19 and 120' are situated, is provided for this purpose on the piston 506. The housing 501 affords the sliding surfaces 110' and 18 in this case. Details of these two chambers have been omitted for the purpose of simplifying the drawing.

With an appropriate construction of the gas passages, which will not be further explained in detail, the chamber 530.532 can be used as a low pressure compression chamber while the pair of chambers 110'.14, 18.14 constitutes a combustion machine in the manner described above which drives the compressor. The low pressure compression chamber 530.532 can, however, also serve as a precompression chamber, whereby the gas precompressed in it is supplied in a suitable manner to the compression chamber 110'.14 for subsequent compression. This would result in a two-stage compressor which can reach very high output pressures. When used as an externally driven compressor the expansion chamber 18.14 could be omitted.

FIG. 21 shows a further constructional detail which is of great advantage when used as a combustion machine to avoid scavenging losses. In the illustrated construction the chamber 18.14 constitutes the expansion chamber with the given direction of rotation of the piston in the clockwise direction. After opening of this chamber the burnt exhaust gas should leave the machine, in the position of the piston 506 illustrated in FIG. 21, through the low pressure outlet passage 522 and, if possible, without mixing with the fresh gas from the low pressure inlet passage 516. Constructed for this purpose on the separating web between the low pressure passages 516 and 522 there is a sliding surface 540 and on a nose 541 on the piston 506 there is a sealing element 542 which, during the critical angular range of the crank in which the expansion chamber 18.14 opens, moves in a sealed manner on the sliding surface 540 and creates a gas seal between the low pressure passages 522 and 516 so that in this critical time period mixing of exhaust gas and fresh gas is prevented.

A number of phases of a workihg cycle are shown in FIGS. 22–27 for a better understanding of the mode of operation of the construction illustrated in FIG. 21. The reference numerals are omitted for the purpose of simplifying the drawings. These will be apparent from FIG. 21.

Figure 25:
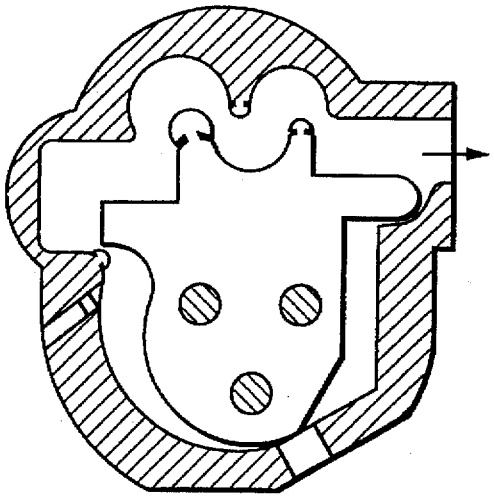
Figure 26:
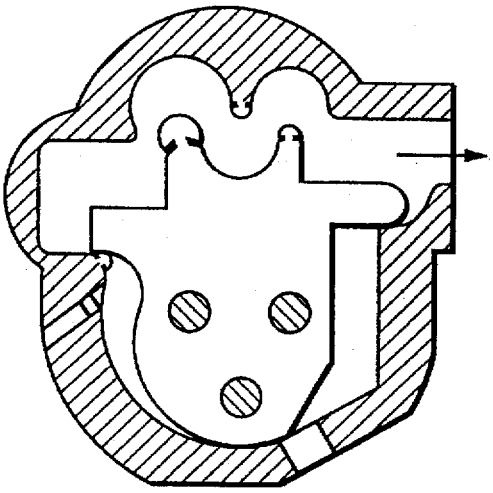
Figure 27:
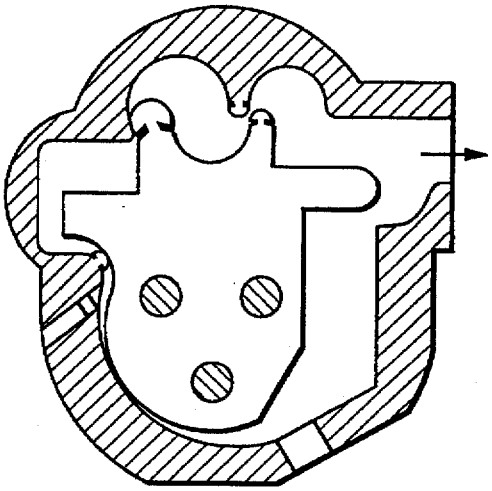

In the position of FIG. 25 the large sealing element 535 on the piston 506 comes into engagement with the sliding surface 530 and begins to pump fresh gas in the clockwise direction. In the angular position of FIG. 26 the large chamber 530.532 closes and begins the compression beyond the position of FIG. 27 to the position of FIG. 22 with gas discharge out of the outlet passage 536. The gas is supplied to the high pressure compression chamber 110'.14 which has just shut at this time and is further compressed by it. The high pressure compression chamber 110'.14, however, receives fresh gas even without help from the low pressure compression chamber so that the low pressure compression chamber can also be used for other purposes.

Figure 22:
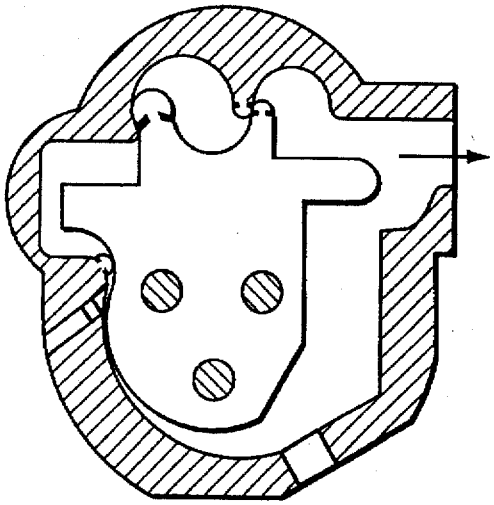
FIGS. 22–27 are views corresponding to FIG. 2 in successive angular positions of the piston.
Figure 23:
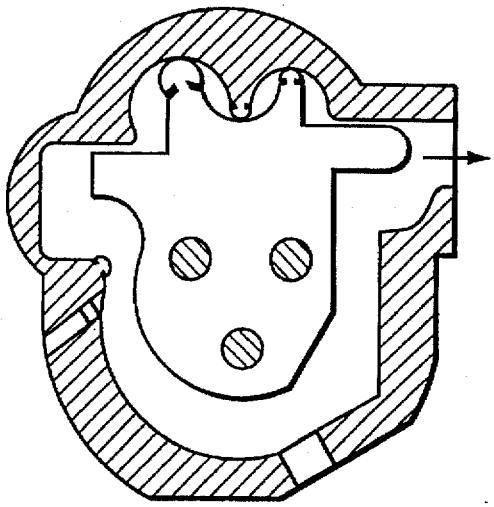
Figure 24:
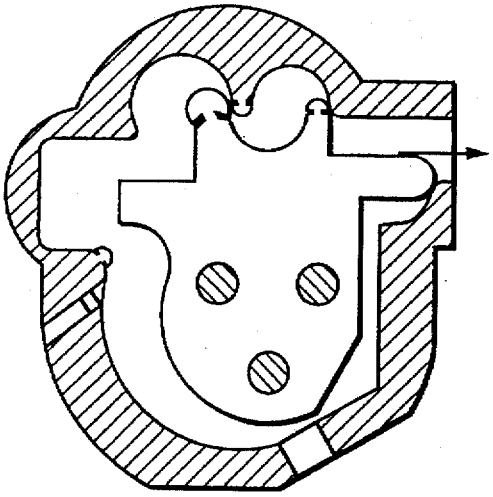

The expansion chamber 18.14 begins the expansion at the position of FIG. 22 and expands to the position of FIG. 24. The sealing element 542 of the nose 541 now comes into sealing engagement with the sliding surface 540 and isolates the low pressure passages 522 and 516 from one another. On opening of the expansion chamber 18.14, which now occurs, exhaust gas flows out of the low pressure outlet passage 522 without mixing with the fresh gas. The scavenging of the exhaust gas is promoted in the positions of FIG. 25 and FIG. 26 by the fact that the piston pumps fresh gas in the clockwise direction with its large sealing element 535.

In the modified embodiments previously described, the sealing elements or sealing strips are always constructed with surfaces of circular cross-section. The sliding surfaces are thus accordingly surfaces of circular cross-section which are traversed by the sealing elements during the course of the parallel rotation.

However, other surface shapes are also possible, particularly such as conic sections, that is to say e.g. sections of circles, ellipses and parabolas and also spiral sections. The opposing sliding surfaces, which are traversed by such sealing element shapes, are similar to the surface shape of the sealing element. They are produced in a simple construction by extending the lines emanating from a common point by the crank radius beyond the surface of the sealing element. As has already been made clear in connection with the exemplary embodiments described above, sliding surfaces of circular cross-section are produced with a circular surface of the sealing element. With an elliptical surface of the sealing element an elliptical sliding surface is produced. Such an example with elliptical surfaces is illustrated in FIG. 28.

Figure 28:
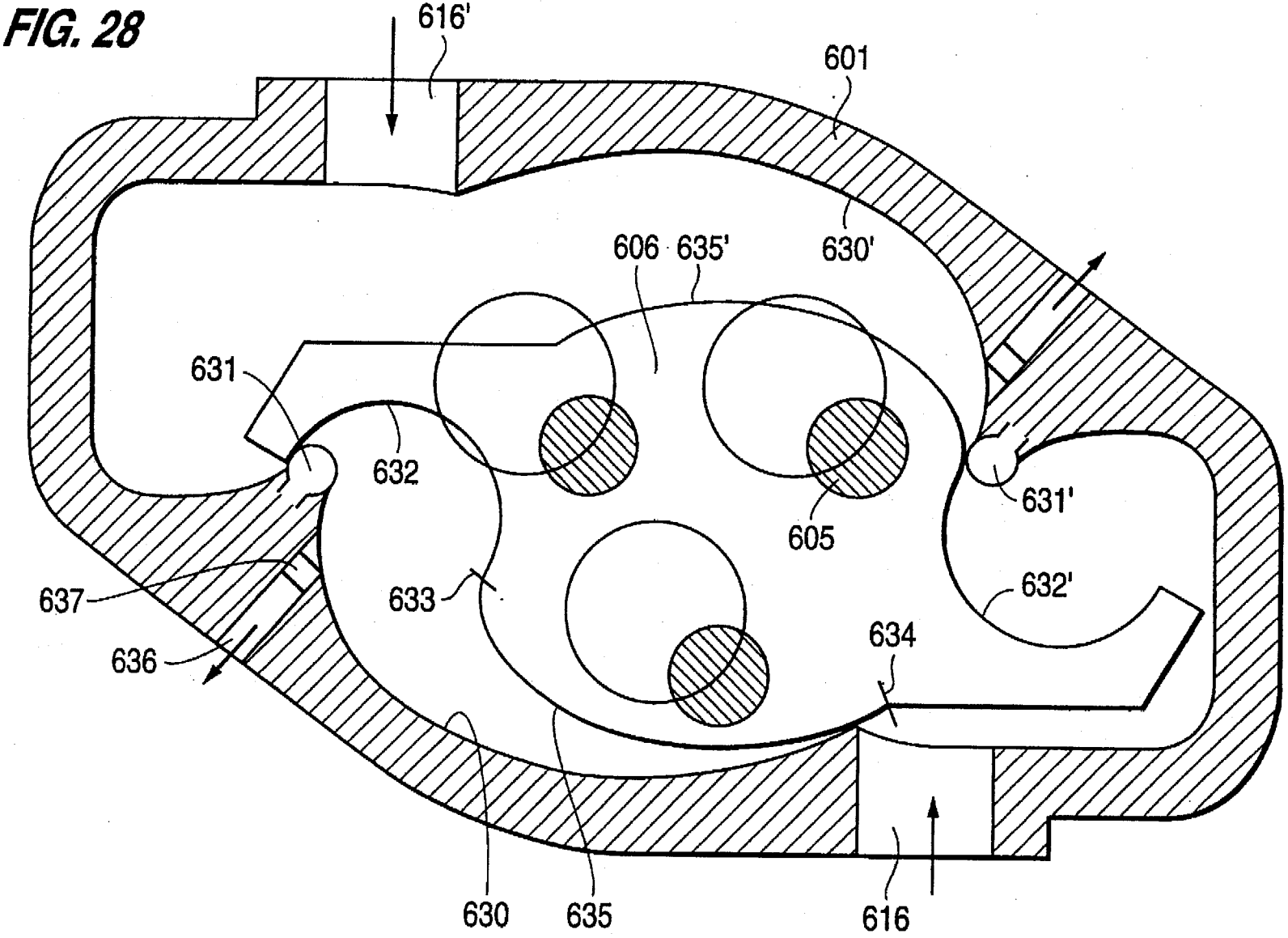
FIG. 28 is a sectional view corresponding to FIG. 2 of a further modification of a piston machine with cylindrical and elliptical sliding surfaces and FIG. 29 is a view of the lower portion of FIG. 21 in a modification with a plurality of sealing strips.

FIG. 28 shows a simple low pressure compressor with two symmetrically arranged, identical chambers.

The compressor has a housing 601 in which a piston 606 rotates in the clockwise direction on three cranks 605. The rotational curves of the centerpoints of the cranks are illustrated with circles.

On the underside of the illustrated piston it constitutes sealing element 635 with a surface of elliptical cross-section which extends from the marking line 633 to the marking line 634. Connected thereto at 633 is a sliding surface 632 of circular cross-section. Arranged on the peripheral wall of the housing 601 is a sealing strip 631 of small cross-section which runs over the sliding surface 632 on the piston.

Formed on the peripheral wall adjacent to the sealing strip 631 is a sliding surface 630 which extends from the sealing strip 631 to a low pressure inlet passage 616.

During parallel rotation of the piston 606 in the clockwise direction, the sealing element 635, which is constructed as a section of an ellipse, moves from the angular position shown in FIG. 28, in which it comes into first contact with the sliding surface, until it contacts the sealing strip 631 and constitutes the sealed boundary of the chamber 630.632. At its other end this chamber is sealed by the sealing strip 631 in contact with the sliding surface 632.

High pressure gas is discharged from this chamber in the direction of the arrow through an outlet passage 636 with a valve 637.

Symmetrically provided on the upper surface of the piston 606 is a second chamber 630'.632' which operates alternately with the first chamber 630.632 described above during rotation of the piston 606.

In the embodiments of FIGS. 21 and 28 the sealing elements 535 and 635, which have very large dimensions with respect to the crank radius, constitute a considerable peripheral proportion of the piston 506 and 606, respectively. These sealing elements 535, 635, are thus constructed as surfaces rigidly connected to the piston and can only form a seal with respect to their opposing sliding surface with a gap seal.

It would of course be desirable to construct these sealing elements also as resiliently mounted sealing strips which achieve a better sealing action. This is, however, difficult, if even technically possible, with surfaces which are so large.

Figure 29:
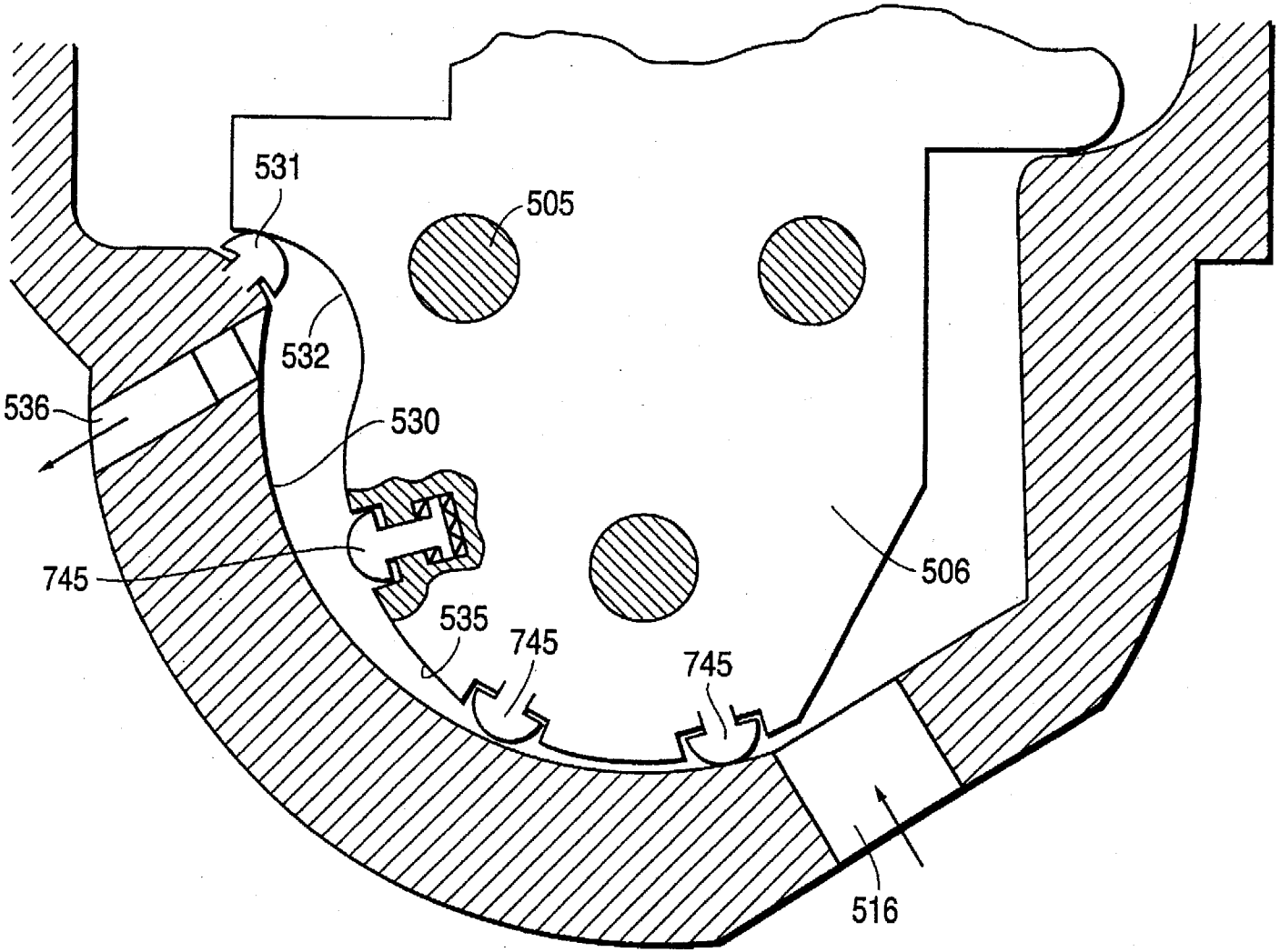

An advantageous solution to this problem is shown in FIG. 29 which shows a portion of the lower portion of a modification of FIG. 21. The same reference numerals are used as in FIG. 21.

In order to achieve a better seal of the circular arcuate sealing element 535 on the sliding surface 530, sealing strips 745 are resiliently mounted in the surface of the sealing elements 535, in fact three sealing strips in the illustrated example.

The sealing strips 745 are resiliently mounted such that they project somewhat beyond the surface of the sealing element 535 and come into good sealing contact with the sliding surface 530 while the surface regions between them of the sealing element 535 remain spaced away. During rotation, the sealing strips 745 come successively into engagement and during parallel rotation of the piston 506 in the clockwise direction the sealing strip adjacent to the low pressure inlet passage 516 is the first and the sealing strip adjacent to the stationary sealing strip 531 in FIG. 29 is the last. A compression chamber may be provided in this manner which has a very large volume but nevertheless can have a very high compression ratio. A corresponding construction with the arrangement of a plurality of sealing strips in the sealing element 635 is also possible in the embodiment of FIG. 28.

I claim:

1. A piston machine comprising the combination of a housing having means defining a working space, said means comprising two parallel walls and an interconnecting peripheral wall extending perpendicularly between said parallel walls, said peripheral wall having a cylindrical first chamber surface with a cylinder axis and first and second ends;

a piston having a cylindrical second chamber surface for engagement with said first chamber surface to form a chamber of variable volume, said cylindrical second chamber surface having a cylinder axis and first and second ends and being movable with said piston relative to said first chamber surface;

at least two identical crankshafts rotatably mounted in said housing perpendicular to said parallel walls and having crank pins rotatable in and supporting said piston, said crankshafts being coupled together for angular synchronous rotation;

a first sealing element mounted on said piston at said first end of said second chamber surface and extending perpendicular to said parallel walls;

a second sealing element mounted on said peripheral wall at said second end of said first chamber surface and extending perpendicular to said parallel walls, each of said first and second chamber surfaces being formed as a sliding surface to slidingly engage a sliding surface of said sealing element of the other of said chamber surfaces over the total length of said other of said chamber surfaces between said ends during a part of parallel rotation of said piston;

means in said housing providing a high-pressure gas passage having a flow-controlling valve and an opening communicating with said chamber adjacent said sealing element at an end of said first sliding surface; and means in said housing providing a low-pressure gas passage communicating with said working space outside of said chamber.

2. A piston machine according to claim 1 wherein each of said sealing elements has a cross-sectional surface shape of a sector of a circle, said sector of a circle of each sealing element having a center spaced from said cylinder axis of the chamber surface slidingly engaged by said sealing element by a distance equal to said crank pin radius, the radius of said engaged chamber surface being equal to said crank radius plus said radius of said surface of said sealing element.

3. A piston machine according to claim 2 wherein said sealing element mounted on said first chamber surface has a shape different from said sealing element mounted on said second chamber surface.

4. A piston machine according to claim 1 wherein said piston has a sealing element at each end of said second chamber surface, one of said sealing elements having a plane of symmetry intersecting said sliding surface of said sealing element and lying perpendicular to said parallel walls, said plane of symmetry of one said sealing element forming an angle greater than 0° with a plane of symmetry intersecting said chamber surface of said piston.

5. A piston machine according to claim 1 wherein sliding surfaces of said sealing elements include teeth extending perpendicular to said parallel walls.

6. A piston machine according to claim 1 wherein said sealing elements include spring means urging said sealing elements toward engagement with said chamber surfaces.

7. A piston machine according to claim 1 and including means for mounting each said sealing element including a mounting piston formed on said sealing element at an end opposite said sliding surface, a mounting cylinder receiving said mounting piston, and a gas passage providing communication between said mounting cylinder and said chamber surface at an end of said chamber surface adjacent said sealing element, whereby gas through said passage acts on said mounting piston to urge said sealing strip into sealing engagement.

8. A piston machine according to claim 1 wherein said peripheral wall comprises a third chamber surface adjacent said first chamber surface, said second sealing element being located between said first and third chamber surfaces, and wherein said second chamber surface on said piston comprises a sealing element at both of said ends, whereby said three chamber surfaces define two adjacent chambers of which one acts as a compression chamber and the other concurrently acts as an expansion chamber during piston rotation.

9. A piston machine according to claim 8 wherein said valve for said high-pressure passage of said compression chamber comprises a one-way valve.

10. A piston machine according to claim 1 wherein said housing comprises a plurality of working spaces each containing an additional piston mounted on said crank pins of said crankshafts for rotation with said first-mentioned piston and each including a peripheral wall.

11. A piston machine according to claim 10 wherein said crank pins are angularly offset from those of said first-mentioned piston.

12. A piston machine according to claim 1 wherein said flow-controlling valve is for opening and closing said high-pressure gas passage, said valve being operated in synchronism with rotation of said piston.

13. A piston machine according to claim 1 and including gear sets for coupling said crankshafts together.

* * * * *